United States Patent [19]

Marion

[11] Patent Number: 4,979,780

[45] Date of Patent: Dec. 25, 1990

[54] MINING OR UNDERGROUND QUARRYING METHOD AND INSTALLATION FOR IMPLEMENTING SAME

[76] Inventor: Rene A. Marion, 11, rue Maurice Barres, 57500 Saint Avold, France

[21] Appl. No.: 324,077

[22] Filed: Mar. 16, 1989

Related U.S. Application Data

[63] Continuation-in-part of Ser. No. 205,127, Jun. 10, 1988, abandoned.

[51] Int. Cl.[5] ..... E21C 41/00; E21D 19/00

[52] U.S. Cl. ..... 299/11

[58] Field of Search ..... 299/10, 11, 15, 19, 299/33

[56] References Cited

U.S. PATENT DOCUMENTS 1,630,589 5/1927 Taber ..... 299/11

FOREIGN PATENT DOCUMENTS 8704210 2/1988 South Africa .
675189 7/1979 U.S.S.R. ..... 299/11
715798 2/1980 U.S.S.R. ..... 299/11
881323 11/1981 U.S.S.R. ..... 299/10
1370242 1/1988 U.S.S.R. ..... 299/11

*Primary Examiner*—Ramon S. Britts
*Assistant Examiner*—David J. Bagnell
*Attorney, Agent, or Firm*—Browdy and Neimark

[57] ABSTRACT

In a mining or underground quarrying method by downward slicing under a roof, the roof is divided into a plurality of areas supported independently of one another. As the core is mined from under this roof, these areas are progressively caved in to a limited height. The method is particularly applicable to mining coal and metal ores.

27 Claims, 15 Drawing Sheets

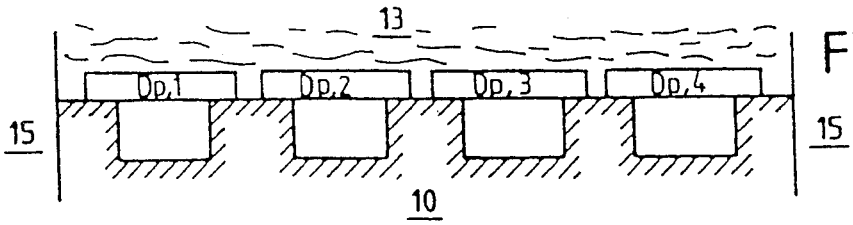
FIG.14
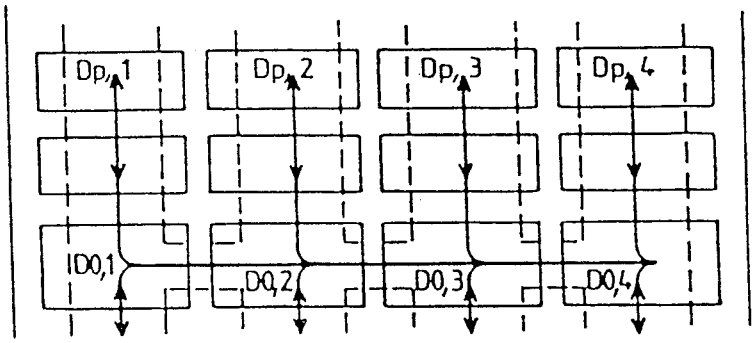
FIG.15
FIG.16
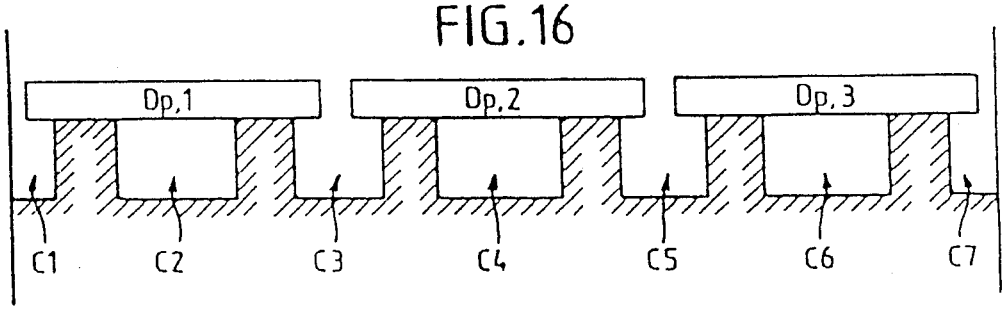
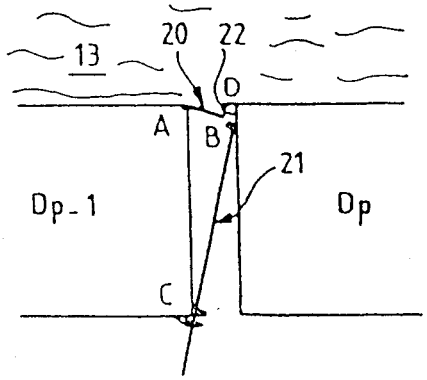
FIG.17

MINING OR UNDERGROUND QUARRYING METHOD AND INSTALLATION FOR IMPLEMENTING SAME

The present application is a continuation-in-part of application Ser. No. 205,127, June 10, 1988, now abandoned the entire contents of which are hereby incorporated by reference.

The invention concerns a new mining or underground quarrying method and a device for implementing it. It is more particularly applicable to deep veins or lodes of ore.

Lodes of this type are won by slicing upwards or downwards. Working conditions are easier with downward slicing whereas upward slicing can cause safety problems associated with winning the ore at the level of the roof.

A number of downward slicing methods have been proposed, but they are not entirely satisfactory.

So-called "flexible floor" methods have been little developed because of operating difficulties and safety problems that they cause, for example. The "tapping" method does not enable complete extraction of the ore and requires substantial preparatory work.

It has also been proposed to form a fixed concrete slab anchored into the walls of the lode (that is to say the rock surrounding the vein of ore) and to mine a slice of ore from under this slab, the operation then being repeated at increasing depths with successive fixed slabs being mined from under the other and the ore being extracted under these: the slabs remain in place and are abandoned as winning of the mine proceeds. This practice is costly as a result of the cost to manufacture the successive slabs and is only applicable to veins of restricted thickness. The strength of the walls of the lode in the mine working is compromised by stresses induced by the slabs remaining in place at higher levels.

Thus there has not yet been developed any entirely satisfactory method for winning deep lodes.

A distinction is drawn between mining operations that proceed by backfilling and operations that proceed by caving in. The latter practice, which entails allowing the overburden above the ore being mined to cave in is more economical than the backfilling method which entails substituting some other material for the extracted ore.

It would therefore seem desirable to attempt to combine downward slicing with the caving in technique.

The present invention is directed to solving this problem by proposing, for deep lodes or veins of ore, a method of downward slicing combined with caving in which is relatively simple and inexpensive and which makes it possible to win and extract all of the ore in great safety.

This objective is achieved by using downward slicing under a roof protecting against caving in, and consisting of a plurality of roof slabs juxtaposed side by side, in substantially the same plane, and preferably substantially horizontal: the ore is mined (by any appropriate method) from these roof slabs which are lowered one by one as the ore is removed.

In other words, the invention proposes to subdivide the roof into a plurality (array) of areas supported independently of one another and, in parallel with the winning of the ore from the ground, to progressively cave in said areas to a limited height. This enables satisfactory control of caving in which is compatible with safety requirements. The areas envisaged here are the portions of the roof supported individually by the aforementioned roof slabs (which are dimensioned in such a way that they can be lowered). It will be appreciated that the invention proposes working under a caved in area, overcoming the prejudices of those skilled in the art against what safety standards allow a priori.

It is important to note that during this lowering the mass of caving material that caves in remains small by virtue of the vault effect induced into the total mass of caving material that is prevented from caving in by the presence of the surrounding slabs that remain fixed. This property makes it possible to choose, for successively lowering the slabs, devices (preferably hydraulic devices) having technical specifications (structure and operation) authorising their manufacture and application on an industrial scale.

It will be appreciated that the method in accordance with the invention leads to high production since it makes it possible to mechanise all of the mining operations. On the other hand, investment is maintained at a reasonable level since the roof slabs descend as the working goes deeper.

In a first embodiment of the invention the roof slabs bear on walls or pillars of ore and the ore is extracted alternately between the walls or pillars and at the top of the latter (with the roof slabs then mechanically supported).

In another embodiment of the invention the roof slabs rest on man-made posts and the ore is won alternately between these and underneath them. In practice these man-made posts are connected to the roof slabs; they are advantageously movable transversely as mining proceeds.

On narrow sites roof slabs are disposed end to end or side by side. For larger workings the roof slabs are preferably aligned in rows and lines; the winning of ore and the lowering of the roof slabs are preferably executed gradually, either line by line or row by row.

The distance between the walls or posts or pillars is, in certain locations at least, greater than the width of mining machines so as to enable these to circulate.

In a further embodiment, more particularly intended for narrow veins, the roof slabs are supported laterally against the walls of the lode, flying buttress fashion, for example, which makes it possible to win the ore from the ground over the full width of the drift.

The invention also proposes, for implementing the aforementioned method, a support installation for downward slicing mining and underground quarrying operations which comprises a roof protecting against cave ins formed by a plurality of independent elementary roof slabs provided with supporting means, together with means for supporting and lowering the roof slabs, having a variable height. In practice the roof slabs are of reinforced concrete.

In a first embodiment of the invention the support means are pillars or walls of the ore to be mined, where this is sufficiently strong.

In another embodiment the support means are man-made. They are fixed posts fastened to the roof slabs or attached to the roof slabs in a way permitting translation along the latter. Like the roof slabs, these posts are in practice of reinforced concrete.

In the case of narrow veins the roof slabs may also be supported by a plurality of horizontal jacks bearing laterally at their ends against a vertical shoulder on the roof slabs and the walls of the lode themselves; in practice these jacks remain in place while the ore is won from under their full width.

In narrow veins, rather than being of unitary construction, the roof slabs may instead be formed by at least two articulated vault elements forming a variable angle vault, supported flying buttress fashion on the walls of the lode, and advantageously complemented by two side or end elements articulated to the vault elements and adapted to lie along the walls of the lode. Horizontal jacks are provided for applying the end elements laterally against the walls of the lode.

It will be appreciated that such roof slabs make it possible to benefit from the weight of the caving material to make it safer to work under the roof slabs in the case of narrow veins whilst making it a simple matter to deal with variations in the width of such narrow veins.

Gaps are left between adjacent roof slabs and between the roof slabs and the side walls of the cavity being won so that each roof slab can be lowered without difficulty. Devices are provided to prevent the caving material passing through these gaps.

A flexible metal mesh is advantageously disposed between the roof formed by the set of roof members and the caving material that they support. As an alternative to this, shields supported by deformable triangles are disposed in the intertices between adjacent roof slabs; for a given intertice between two roof slabs, the shield is preferably carried by that of the roof slabs which is designed to be lowered first while the other carries a cusp designed to press down on the shield when this other roof slab is lowered.

The plurality of elementary roof slabs preferably comprises at least one row in which the support means are sufficiently far apart to allow mining machines to pass between them.

The controlled supporting and lowering means preferably comprise hydraulic jacks or airbags advantageously operating on the roof slabs through the intermediary of distribution plates or on the pillars through the intermediary of fixtures with which they are provided for this purpose. The controlled support and lowering means are advantageously fixed to one or more removable frames used successively for different roof slabs. In the case of articulated roof slabs the support and lowering means are operative on the end elements, for example by means of transverse rails under the horizontal bearing surfaces of these elements.

The thickness of the roof slabs and the geometry of the pillars are calculated so that the assembly can support the weight of the caving material. Sensors are advantageously provided, either on the roof slabs (to measure their deflection) or between the roof slabs and pillars (pressure sensors) to enable the load supported by the roof slabs to be monitored in order to verify that it remains within the operating limits of the roof slabs.

The objects, characteristics and advantages of the invention will emerge from the following description given by way of non-limiting example with reference to the appended drawings, in which:

FIG. 1 is a view in longitudinal cross-section through a mine working in accordance with the invention for winning a vertical vein of ore, FIG. 2 is a view of it in transverse cross-section, FIGS. 3 and 4 are views in transverse and longitudinal cross-section of a similar mine working being won by the method in accordance with the invention, FIGS. 5A through 5D are side views of a roof slab with sideways movable posts during four consecutive phases of winning the ore, FIGS. 6A through 6D are views in longitudinal cross-section of a mine working similar to that of FIGS. 1 through 4 and showing four consecutive phases of winning the ore by an alternative method in accordance with the invention, FIG. 7 is a view in tranverse cross-section through a wide working, FIG. 8 is a plan view of another wide working, FIG. 9 is a view in lateral elevation of a roof slab supported by pillars of ore in a narrow working, FIG. 10 is a simplified view of it in an intermediate stage of winning the ore, FIG. 11 is a view in longitudinal cross-section in the intermediate stage of FIG. 10, FIGS. 12 and 13 show variations on FIG. 9, FIGS. 14 and 15 are respectively a view in tranverse cross-section and a plan view of a wide working in which the roof slabs are supported on the ore to be won, FIG. 16 shows a variation on FIG. 14, FIG. 17 is a view in partial tranverse cross-section through two adjacent roof slabs fitted with a protective shield, FIG. 18 is an exploded plan view of the four component parts of an articulated roof slab in accordance with the invention, FIG. 19 is a side view of a roof slab of this kind in a steeply sloped vein of ore, FIG. 20 is another side view of this roof slab in a similar vein of greater power, FIG. 21 is a partial schematic view in elevation of a device for supporting and guiding the lowering of an articulated roof slab of an alternative embodiment, FIG. 22 is a perspective view of this device, FIG. 23 is a side view of another roof slab in accordance with the invention in a completely flattened out configuration, FIG. 24 is a view in transverse cross-section through a narrow drift the roof of which is formed by flat roof slabs fitted with lateral support jacks, FIG. 25 is a view in longitudinal cross-section showing a lifting carriage for installing jacks for supporting and lowering roof slabs, and FIG. 26 is a view of this drift in longitudinal cross-section and to a smaller scale showing a number of slabs side by side.

FIGS. 1 through 26 show various embodiments of a timbering and walling installation for winning ore (coal, metal ores, etc) by downward slicing with progressive, controlled and localised caving in. The mining may be done by means of a conventional technique (cutting, ploughing, blasting, etc), the working face progressing from one roof slab to another. The working height is an important parameter but is totally under the operator's control provided that an appropriate mining machine is used.

FIGS. 1 and 2 show a mine working in accordance with the invention in which a plurality of roof slabs D1, are disposed side by side. This is a narrow working and the generally parallelepipedal roof slabs are disposed transversely.

The roof slabs Dl, etc. are supported by posts P disposed tranversely to the roof slabs in such a way as to leave one or more corridors C1, C2, etc. The posts are supported on a lode 10 of the ore to be mined.

At the ends of the working are two vertical mine shafts 11 and 12 for entry of air and access by personnel, on the one hand, and removal of the ore and exhausting of air, on the other hand.

The roof slabs in combination support a mass 13 of caving material; between the roof slabs and the caving material is a flexible metal mesh 14 which is fixed into the surrounding rock 15 (the walls of the lode) by anchor bolts 16.

Dp−1, Dp, Dp+1, etc designate any consecutive roof slabs of the plurality of roof slabs D1, etc.

FIGS. 3 and 4 illustrate in a schematic way an intermediate stage of the mining operation in which a central working 1 between two posts P has already been mined over all of the length of the working (as an alternative to this, not shown, the working 1 is mined in a discontinuous way, roof slab by roof slab, alternately with the lateral workings 2).

The lateral workings under the posts P are mined slab by slab, each slab being lowered by the working depth as mining proceeds, with controlled and localised caving in.

In FIG. 4 the lateral workings 2 that have been mined under the posts of the roof slabs up to Dp−1 are in the course of being mined under the posts of the roof slab Dp. A (preferably hydraulic) support device (not shown) holds up the roof slab Dp during this mining. The device then lowers the roof slab Dp and the posts P which are fastened to it to the same level as the previous roof slabs.

To facilitate mining under the posts these are advantageously movable laterally as shown in FIGS. 5A through 5D.

In FIG. 5A the posts P′ are as close together as possible; the lateral workings 1 are first mined over the whole length of the working.

The posts are then moved apart until they are over the mined lateral workings and then the roof slabs are lowered; the posts P′ thus border a central working 2 which is then mined (FIG. 5B).

To carry out the next phase of mining the posts may first be returned to the close together configuration and the operations just described repeated.

It is preferable to proceed in the converse manner, beginning by mining the central working 1′ (FIG. 5C) and then, after the posts have been moved together and the roof slab lowered, by mining the lateral workings 2′ (FIG. 5D).

In this way the mining cycles alternate, as per FIGS. 5A and 5B or as per FIGS. 5C and 5D.

FIG. 6A and 6B show an alternative method in which a central working is mined first, as previously. In this instance each roof slab is fitted with support and lowering devices 17. In FIGS. 6A and 6B the mining of the lateral workings (for reasons of clarity the "front" posts of the roof slabs have been omitted) is in progress under the posts of the roof slab D4 which, like the previous roof slab D3, is resting on its supports 17. Before beginning to mine the ore under the posts of the roof slab D5 (FIG. 6C), while this roof slab is rested on its support and lowering means 17, the roof slab D3 is lowered by provoking a cave-in above it (FIG. 6D). There is thus an offset of one roof slab between the last slab to be lowered and the slab under which the ore is being mined. This can facilitate the mining operation by increasing the amount of space available.

As an alternative to this a reduced number of sets of hydraulic jacks 17 is mounted on a movable frame 18 (see under the roof slab D1). These jacks are preferably operative on the roof slabs through the intermediary of a distribution plate 19.

The working may advance line by line of roof slabs or row by row of roof slabs. To facilitate the circulation of mining machines from one line to another there is provided from place to place a row of special roof slabs D0,1 through D0,4 the posts P′ of which have a gap in them.

FIGS. 9 through 16 show alternative embodiments in which the roof slab Dp rests on walls or pillars M consisting of the ore that is to be mined. In this case the workings are situated at different levels (see FIG. 9).

The central working 1 between the pillars M is mined first. The roof slabs are then rested in succession on their supports 17 and the ore is then mined from the upper part of the pillars M (see FIGS. 10 and 11 in the case of a narrow working).

Figure 12:
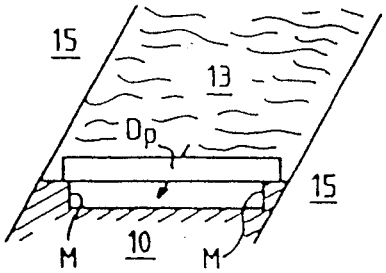
Figure 13:
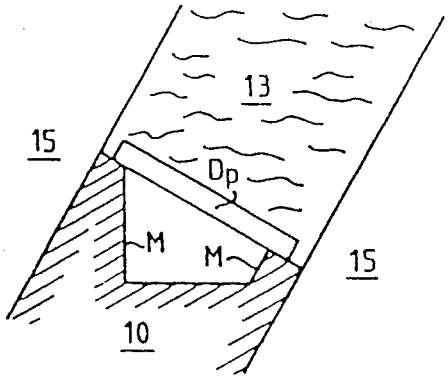

If the walls of a vein are not vertical the same principle is applied, the lowering of the roof slabs having to be accompanied by their horizontal translation (see FIG. 12). As an alternative to this, the roof slabs Dp are inclined so as to be substantially perpendicular to the walls of the vein (FIG. 13).

FIGS. 14 and 15 show a similar but wider working with a plurality of parallel lines of slabs Dp,1 through Dp,4.

Figure 1:
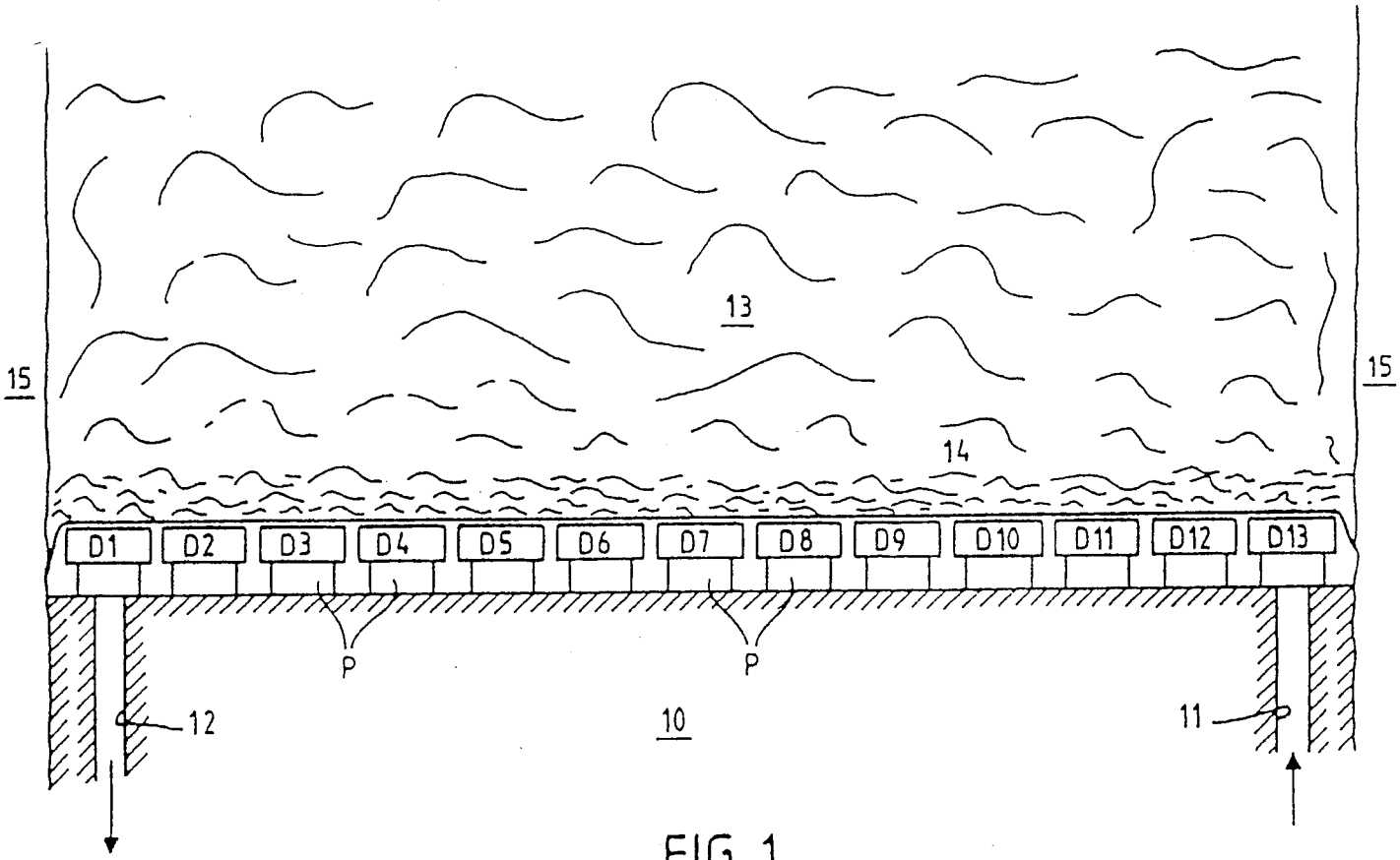
Figure 2:
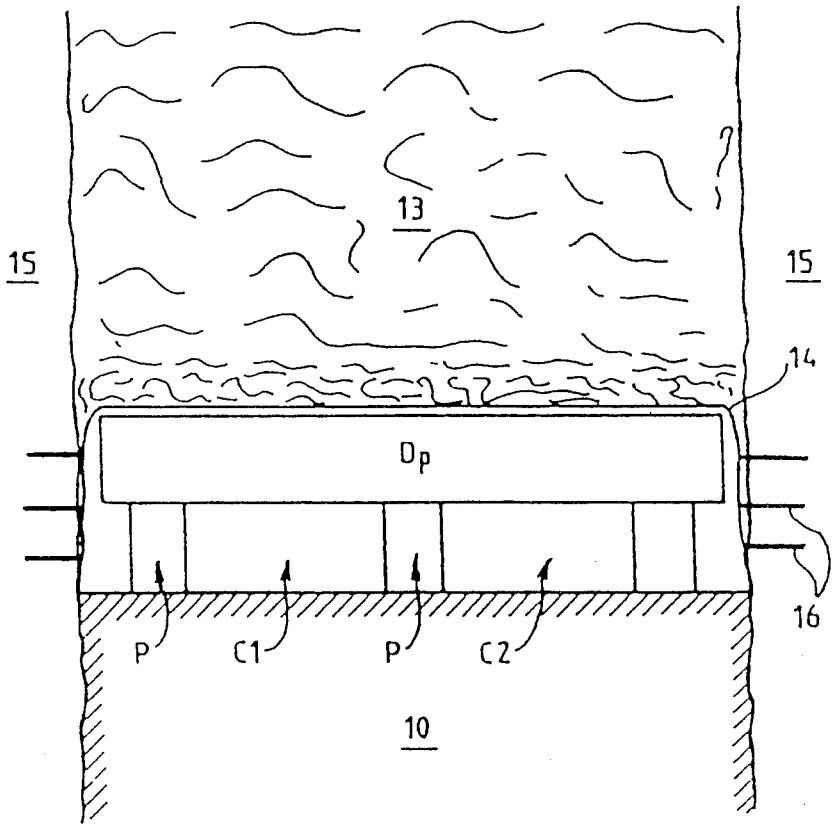
Figure 3:
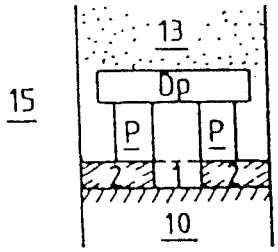
Figure 4:
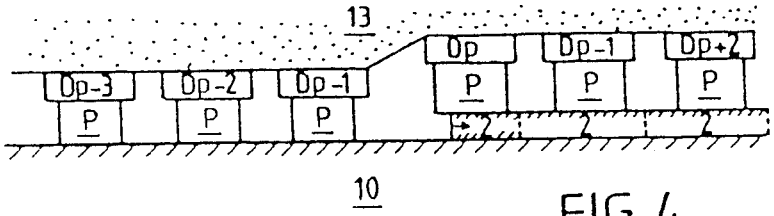
Figure 5A:
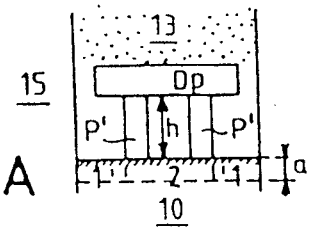
Figure 5B:
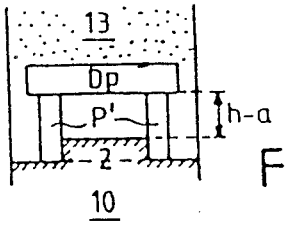
Figure 5C:
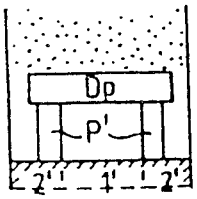
Figure 5D:
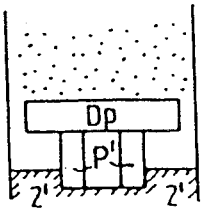
Figure 6A:
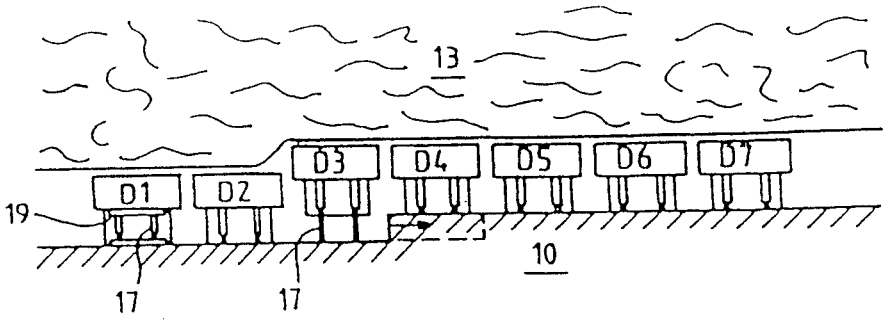
Figure 6B:
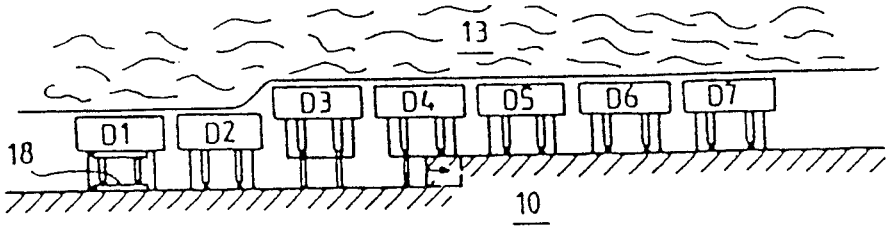
Figure 6C:
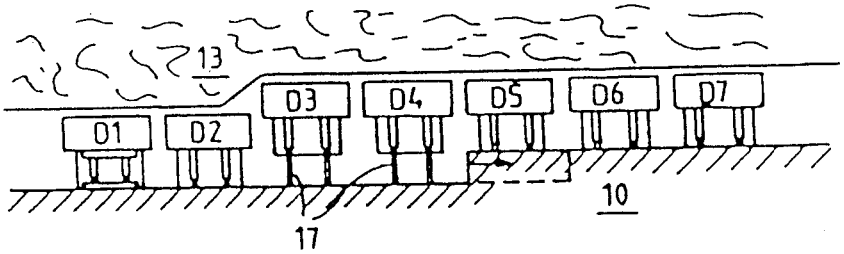
Figure 6D:
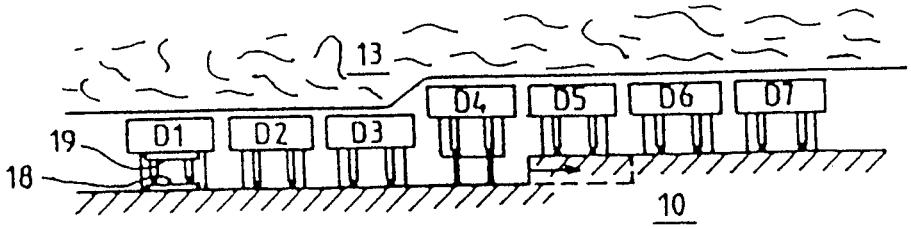
Figure 7:
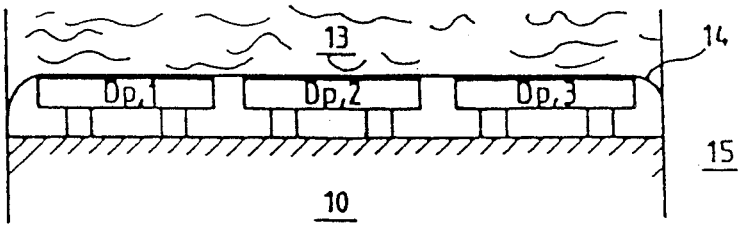
FIG. 7 shows three lines of side by side roof slabs Dp,1, Dp,2, Dp,3 surmounted by a common protective mesh.
Figure 8:
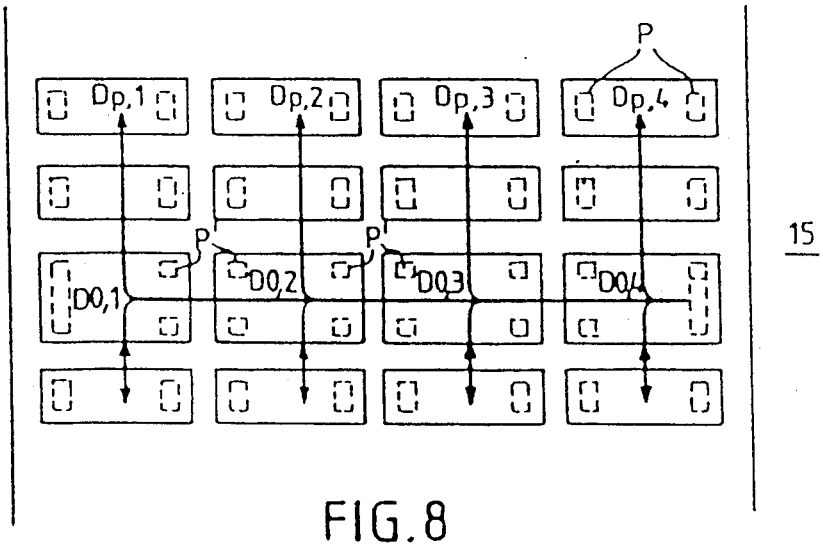
FIG. 8 shows from above four rows of roof slabs Dp,1 through Dp,4 defining a succession of rows of four slabs.
Figure 9:
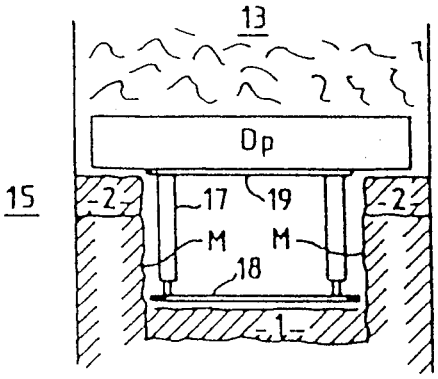
Figure 10:
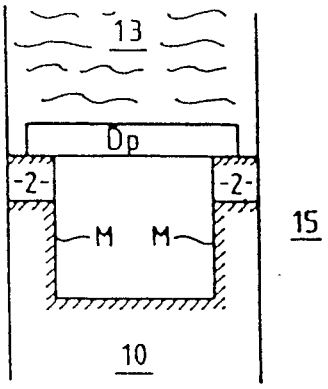
Figure 11:
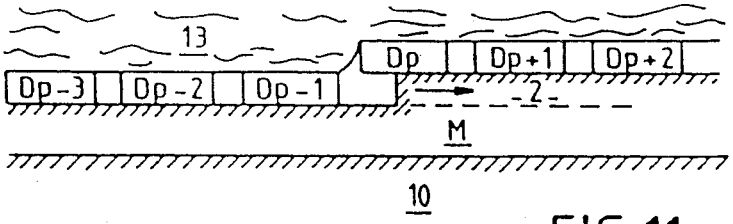

The same remarks apply here as to FIGS. 7 and 8. Note the roof slabs in FIGS. 14 and 15 rest at their ends on common walls of ore which are interrupted under the slabs D0,1 through D0,4 to allow mining machines to pass through.

FIG. 16 shows a variation on FIG. 14 in which the roof slabs in the same row rest on separate walls or pillars, leaving corridors under each slab and between the slabs (the number of corridors C1 through C7 is greater than in FIG. 14 for a smaller number of lines of slabs).

The choice between these configurations will depend on the mechanical strength of the pillars and on the width of the working.

As is known per se in the mining art, the gaps between the roof slabs are generally protected by a flexible and continuous metal mesh unrolled over the roof slabs when the working is started.

Sealing may be provided between the roof slabs by any known method should this be necessary.

As an alternative to this, such protection may be provided by shields 20 supported by deformable triangles 21 as shown in FIG. 17.

Each triangle comprises:

- a side AC consisting of the roof slab to be lowered first (for the gap concerned),
- a side AB of constant length pivoted at A to the roof slab and pivoted at B to the side BC, this side AB supporting the protective shield,
- a side BC of variable length, pivoted at B to the side AB and sliding at C through a bracket fixed to the roof slab, this sliding movement optionally being braked by means of key.

The roof slab Dp, the second to be lowered, comprises a cusp 22 which pushes down the apex B of the articulated triangle and so seals the device.

A device (not shown) is advantageously provided for protecting the gaps between the roof slabs and the walls of the working and for supporting the roof.

This device has a double role. It prevents caving material falling into the working and it makes it possible to adapt the method to changes in the width of the working. The pressure of the caving material in contact with the wall of the working is generally low because of the presence of the roof slabs which take all the load.

This device (that which is not shown) makes it possible to provide protection by simply advancing forepoling irons through pins fixed into the roof slab, these forepoling irons carrying a wooden or iron platform. These easily advanced and retracted forepoling irons make it possible to adapt to variations in the width of the working. Conventional pit props may be employed when the forepoling irons are extended a long way.

This device may be operated hydraulically or manually (the forepoling irons can be moved by the strength of the hand alone).

The arrangement of the roof slabs in lines and rows enables room and pillar working with cross driving. It is therefore possible to use known equipment for room and pillar mining to win the ore (cutting machines, for example).

Also, the existence of the roof slabs, because of the resulting ease of providing or installing any necessary suspension means, makes it possible to provide in this type of working all the necessary equipment for lifting the ore and transporting it on an overhead monorail.

To give an example, for mining a vein of ore 17 meters wide the roof slabs (or beams) used are 16 meters long, 2 meters wide and 1.5 meters deep. The corresponding pillars are cubical with a side length of 2 meters and they are 7 meters apart. A reinforced concrete roof slab of this kind may be designed to withstand a loading of 200 000 kg/m$^2$, conventionally corresponding to approximately 80 meters of caving material.

The jacks constituting the supporting and lowering means 17 have a travel of 1.6 meters, for example, a sliding load of 200 tonnes and a lifting force of 170 tonnes. The complete device may comprise between six and eight jacks.

A distinction has to be drawn between two cases in designing these supporting and lowering means:

First case: The roof slabs are supported by pillars of ore rather than by concrete posts. In this case a movable frame carrying the six to eight jacks is placed under the roof slab to be supported. The device then supports the roof slab while the pillars are mined and then lowers it. It is then moved to the next roof slab. If the surfaces of the roof slabs are such that a single frame does not ensure stability, then the roof slab lowering devices are duplicated and placed in such a way as to ensure stability.

Second case: The roof slabs are supported on concrete posts.

First variant: The posts are fixed to the roof slabs. In this case a frame may be used as in the first case or the jacks may be fixed onto the posts by means of fixings fitted when the posts are made.

Second variant: The posts are movable. In this case the use of frames is mandatory.

For both variants if the roof slab surfaces are such that a single frame does not ensure stability then the devices will have to be duplicated.

Figures 18A, 18B:
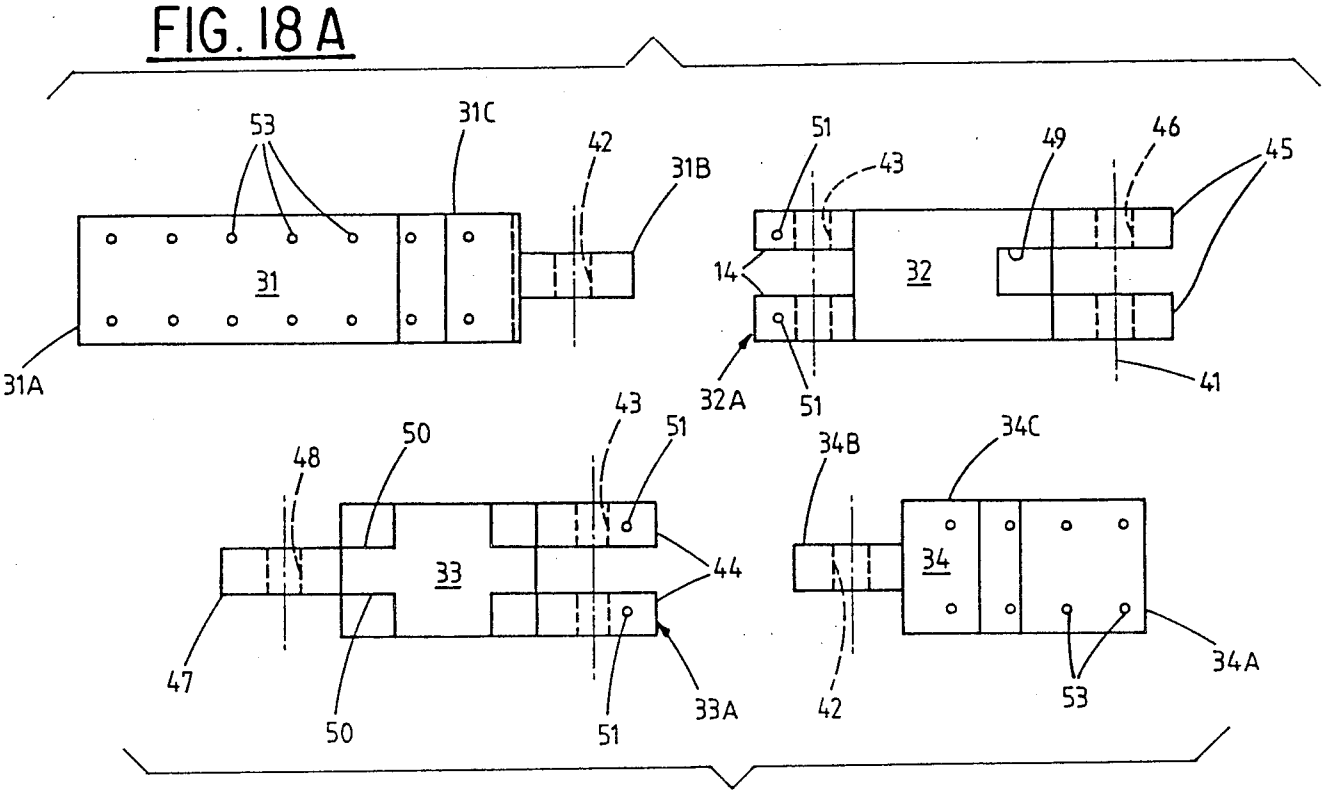
Figure 19:
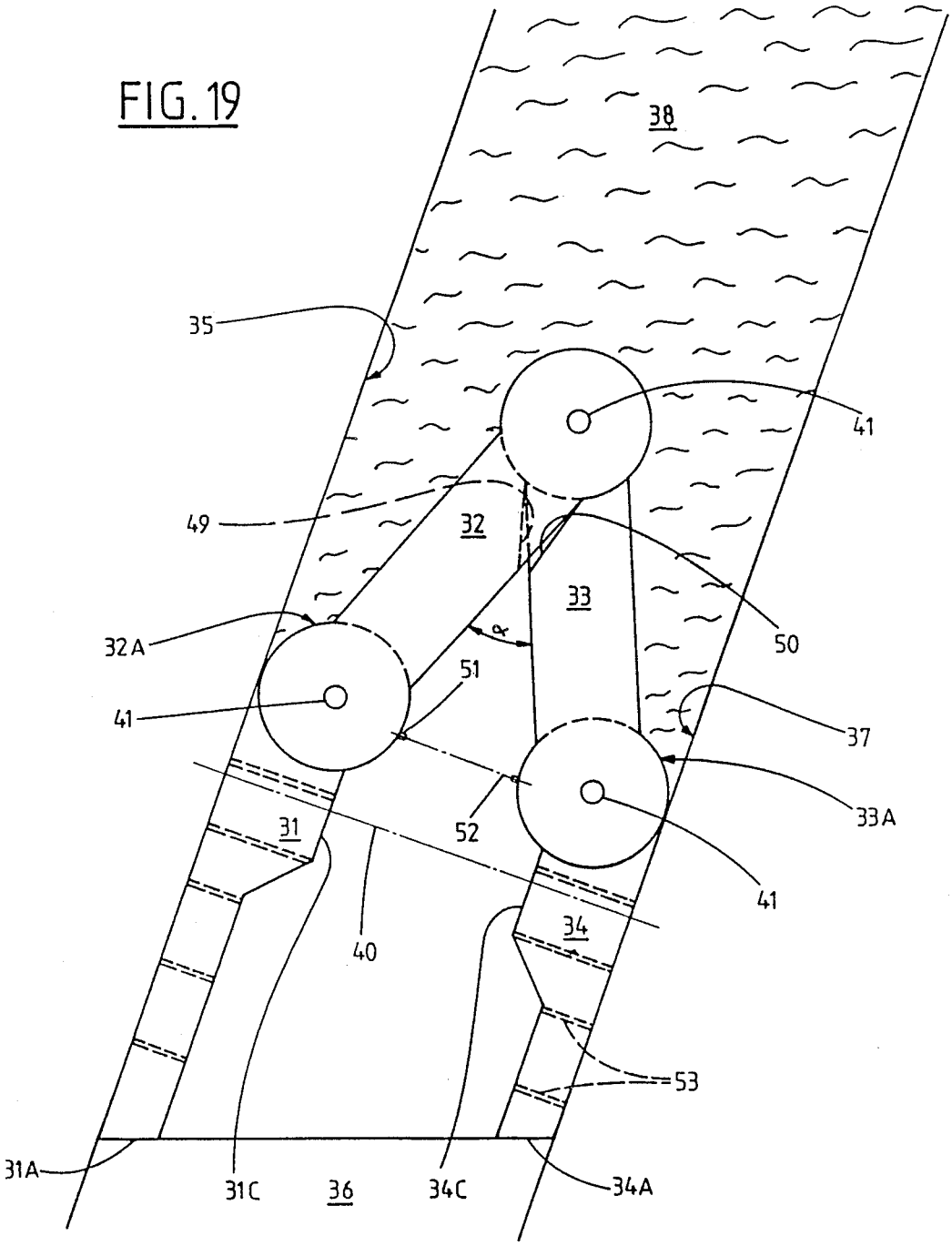
Figure 20:
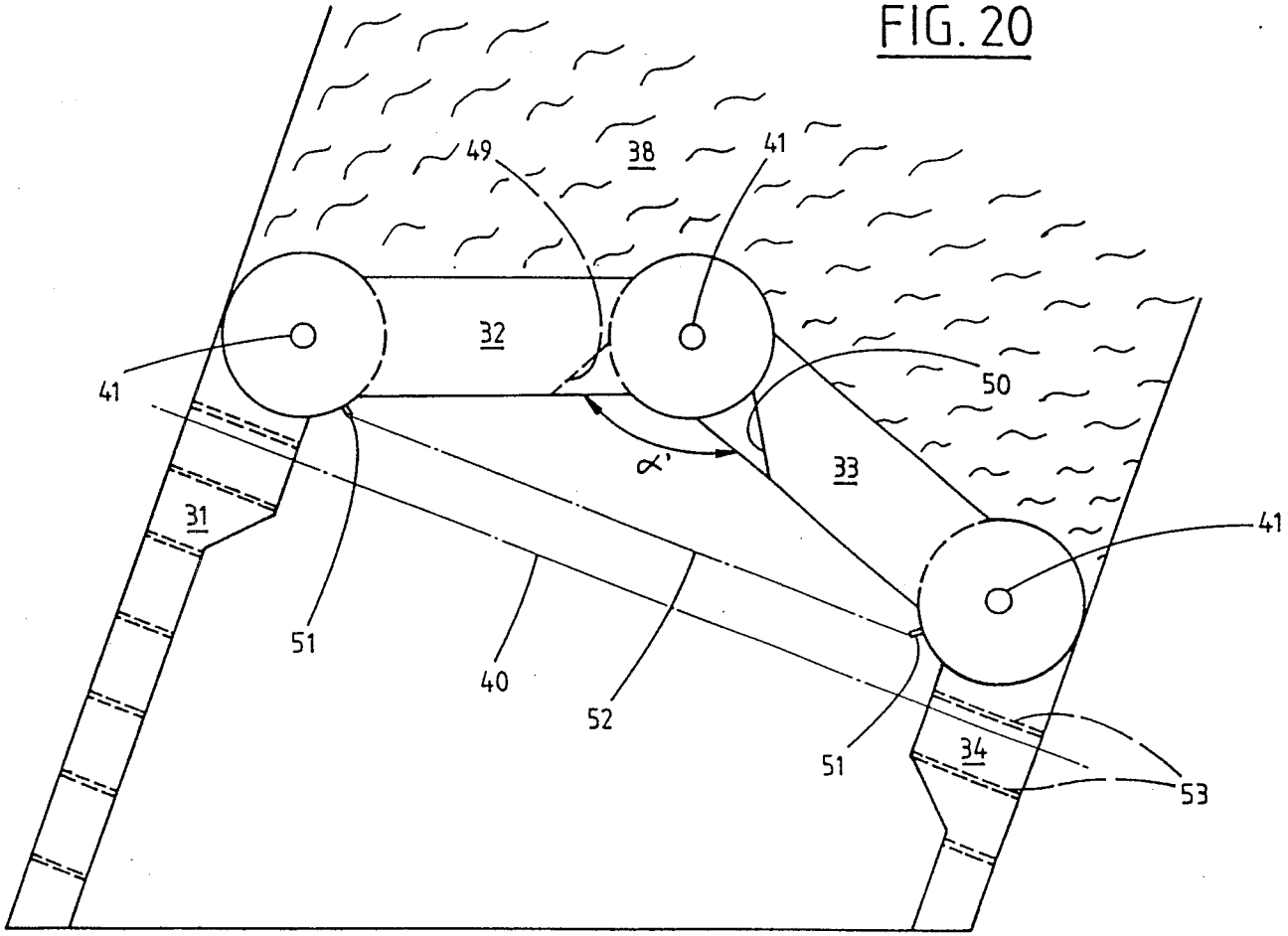

FIGS. 18 through 20 show an articulated roof slab comprising four successive elements 31, 32, 33 and 34 hinged together. This embodiment of roof slab, (in practice of concrete) is for sloping veins having a thickness from 2.8–3 meters to 8 meters in the case of a nearly vertical orientation or more for veins inclined at less than 45° to the vertical.

The end elements 31 and 34 are in practice substantially parallel. The element 31 is disposed along the roof 35 of the vein 36 of ore while the element 34 is disposed along the wall 37 of the vein. These elements, referred to as the "roof element" and the "wall element", are adapted to rest against the ore through their lower ends 31A and 34A.

The intermediary elements 32 and 33 together form a vault the angle $\alpha$ or $\alpha'$ of which is proportional to the width or power of the vein of ore, as can be seen by comparing FIGS. 19 and 20. This variable vault angle makes it possible to adapt to variations in the width of the vein.

Figure 23:
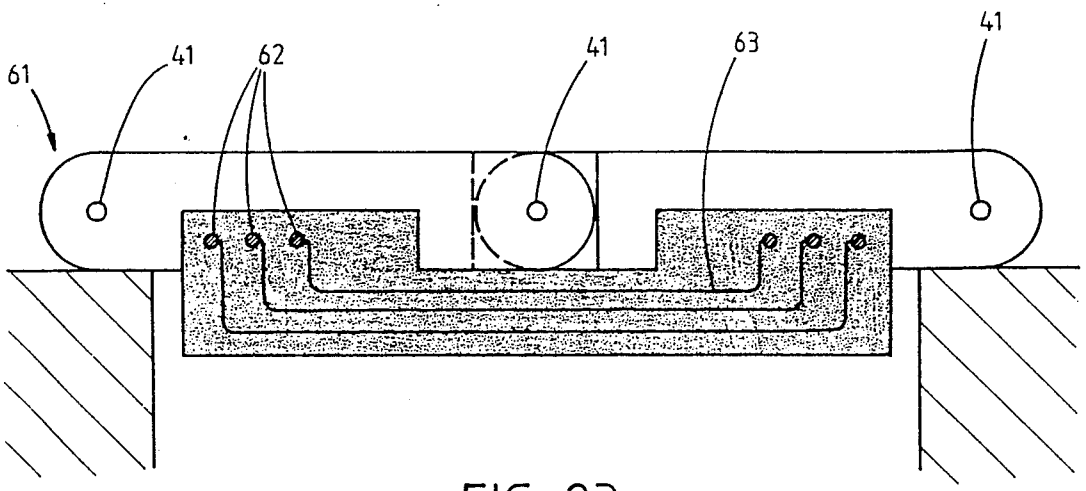

In the extreme configuration shown in FIG. 23 this angle is 180° and the vault is completely flattened out.

The caving material 38 pressing down on the vault tends to widen the angle, by flattening it, causing a lateral thrust on the lower edges 32A and 33A of the vault elements, respectively towards the roof and towards the wall, whereby the roof slab is transversely anchored, flying buttress fashion, to the roof and the wall (silo effect); as a result, the end elements are pressed strongly against the roof and the wall and this may be sufficient to retain the roof slab even if the ore is mined from under the feet 31A and 34A of these end elements. A separator jack 40 (shown in schematic form only by its line of action in FIGS. 19 and 20) may nevertheless be added to reinforce this transverse pressure.

It will be appreciated that the lateral pressure of the end elements slabs 31 and 34 against the walls of the lode, that is to say the rock constituting the roof and the wall, is proportional to the angle of the vault (provided that this remains below 180°): there is a proportional relationship between the weight of the caving material to be supported and the resulting transverse pressure whereby all or part of this weight can be resisted.

The structure of the elements 31, 32, 33 and 34 is seen clearly from FIGS. 18 and 19 (or 20), especially with regard to how they are hinged together.

Each pair of component elements is hinged together by two lateral hinge members fastened to one of the elements and lying one on each side of a central hinge member fastened to the other element. In an alternative arrangement that is not shown the articulation is achieved by interleaving an odd number of hinge members, on the one hand, and an even number of hinge members, on the other hand, so that the elements show overall symmetry relative to a vertical plane perpendicular to the articulation axis. In this way each element can have the same number of hinge members.

The hinge members of each hinge are held in coaxial relationship by round bars 41, of steel, for example, materialising the articulation axis.

Each of the end elements comprises a central hinge member 31B or 34B through which is a bore 42 for the bar 41; the vault elements 32 and 33 each comprise a pair of lateral hinge members 34 adapted to lie one to each side of the central hinge members 31B and 34B through which are bores 43 for the bars 41 to pass through. These lateral hinge members form the lower bearing edges 32A and 33A of the vault elements.

Opposite its end 32A the element 32 carries a pair of hinge members 45 with bores 46 adapted to lie one on each side of a central hinge member 47, in which is a bore 48, carried by the element 33 opposite its end 33A.

To enable the angle between the vault elements to assume small values a triangular-shape central recess 49 is provided in the element 32 between the roots of the hinge members 45 and similar recesses 50 are provided in the element 33 on either side of the root of the central hinge member 47. These recesses permit nesting of the roots of the hinge members: this nesting is virtually to the maximum extent possible in FIG. 19, the roots of the hinge members occupying virtually all of the volume of the recesses. The diameter of the hinge members is preferably greater than the thickness of the elements 31 and 34, to facilitate such rotation and reduce the size of the recesses needed.

As seen more clearly from FIGS. 19 and 20, the end elements 31 and 34 feature, at the hinge members 31B and 34B, areas 31C and 34C that are thicker than their lower ends, adapted to withstand the mechanical stresses appearing at the hinge members in service.

It is generally desirable for the plane containing the articulations between the end elements 31 and 34 and the vault elements 32 and 33 to be substantially perpendicular to the roof 35 and to the wall 37. To this end the end elements may be of different lengths, adapted to bear on an approximately horizontal ground surface through their lower ends, which are advantageously chamfered: the ore in the ground can then be mined in horizontal layers even though the vein 36 slopes.

Pegs 51 are preferably provided on the lateral hinge members of the vault elements, for attaching temporary jacks (represented by their axes 52) which assist with lowering of the roof slabs.

Networks of transverse bores 53 are advantageously provided in the end elements 31 and 34 to enable them to be bolted into the roof and the wall, if necessary. FIGS. 18, 19 and 20 shown right-angle networks of bores 53 of slightly differing design.

For a gently sloping vein (at 30° to the vertical, for example) 8 meters thick the elements might have the same width of 1.5 meters, for example, with hinge members 0.5 meters thick. The elements 32 and 33 are 4.9 meters long (including the hinge members) and the lengths of the elements 31 and 34 are respectively 6.2 meters and 4 meters. The width of the roof slabs may even be less than this (0.8 meter to 1 meter, for example).

In use a plurality of articulated roof slabs are placed side by side and the ore is progressively mined from underneath each of them. Mining can proceed under the ends 31A and 34A of the end elements provided that the lateral anchoring of the roof slabs into the walls of the lode (roof and wall) is sufficiently strong. The jack 40 is provided for reinforcing this fastening by applying a separating thrust between the roof and the wall, perpendicularly to them (whence the benefit of the articulations 31–32 and 33–34 being in a plane perpendicular to the roof and the wall); however, it may be dispensed with or neutralised (at least when no mining is in progress) once the caving material has been correctly distributed over the vault 32–33. If necessary supplementary jacks (not shown) may be mounted on the roof slab, in practice under the jack 40, to further reinforce the pressure of the end elements against the wall and the roof.

After a layer of ore has been won from under a roof slab the latter is lowered by any appropriate means: the lateral supporting force is reduced and the lowering of the roof slab along the wall and the roof proceeds in a controlled copy.

To reduce the lateral supporting force the first step is naturally enough to reduce the separation thrust applied by the jack 40, and the complementary jacks, between the elements 31 and 34. Also, the jack 52 can pull the lower ends 32A and 33A of the vault elements towards on another.

In a very generalised way, this guidance is provided by a support and lowering device comprising:

- hydraulic means (jacks) for taking the weight of the roof slabs;
- a metal framework adapted to guide the roof slabs;
- complementary traction means should this prove necessary.

This device is mobile, preferably self-propelled and fitted with tires.

If no traction means are required, the lowering of the roof slab may be controlled by means of jacks fixed removably to the vault elements of the roof slab, using fixing provided in the roof slab when it is manufactured.

Figure 22:
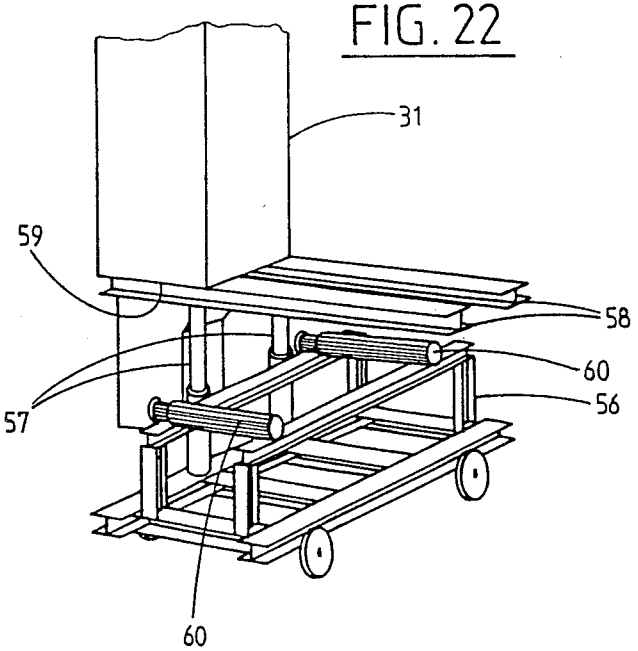
Figure 21:
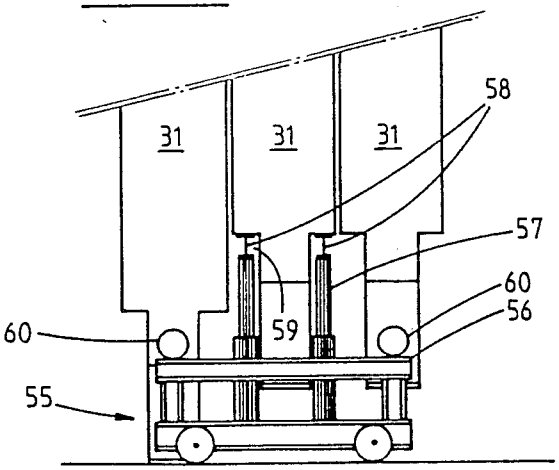

FIGS. 21 and 22 show part of a mobile device 55 with no traction means. The device comprises a movable frame 56, vertical jacks 57 supporting cross members 58 on which the end elements bear through recesses 59 provided for this purpose, and horizontal jacks 60 for anchoring the device laterally to the roof slabs on either side of that being lowered. The frame 56 is placed alongside a similar frame for lowering the other end element of the roof slab.

FIG. 23 shows in cross-section an alternative articulated roof slab which is completely flattened out, for example because the width of the vein is excessive. The main difference between this roof slab 61 and that of FIGS. 18 through 20 (apart from minor differences in the profile) lies in the presence of held over transverse irons 62 provided in the vault elements when they are made. Reinforcing irons 63 are attached to these transverse irons, on each side of the articulation axis 41 of the vault, the latter having been flattened out. The vault may be held in the horizontal configuration by an abutting relationship between facing surfaces provided on the vault elements and/or by supporting the articulation areas of the vault on the irons 63, which are then reshuttered to stiffen the roof slab. The end elements can then be dispensed with, so that only a horizontal roof slab remains. A unitary construction roof slab of this kind may be rested on appropriate supporting means (ore walls or concrete posts).

If an increase in the power of the vein renders roof slabs of a particular type unusable, they may be left in place by bolting the end elements into the walls of the lode by means of the bores 53; new roof slabs are a more appropriate type are then installed under the previous ones so that mining can continue.

The following preferred arrangements are not shown in the figure:

- the end elements may feature narrower areas (by virtue of the previously mentioned recesses 59, for example) enabling wooden chocks to be inserted between these elements and the walls of the lode where these are irregular;

the thruster jacks 40 and the traction jacks 52 may be replaced by double-acting jacks for performing both actions;

the roof slab elements may feature, facing the edge of the hinge members of the elements articulated to them, rounded plates (mating to these edges with clearance) which may form part of the shuttering of these elements at the time they are fabricated.

Figure 24:
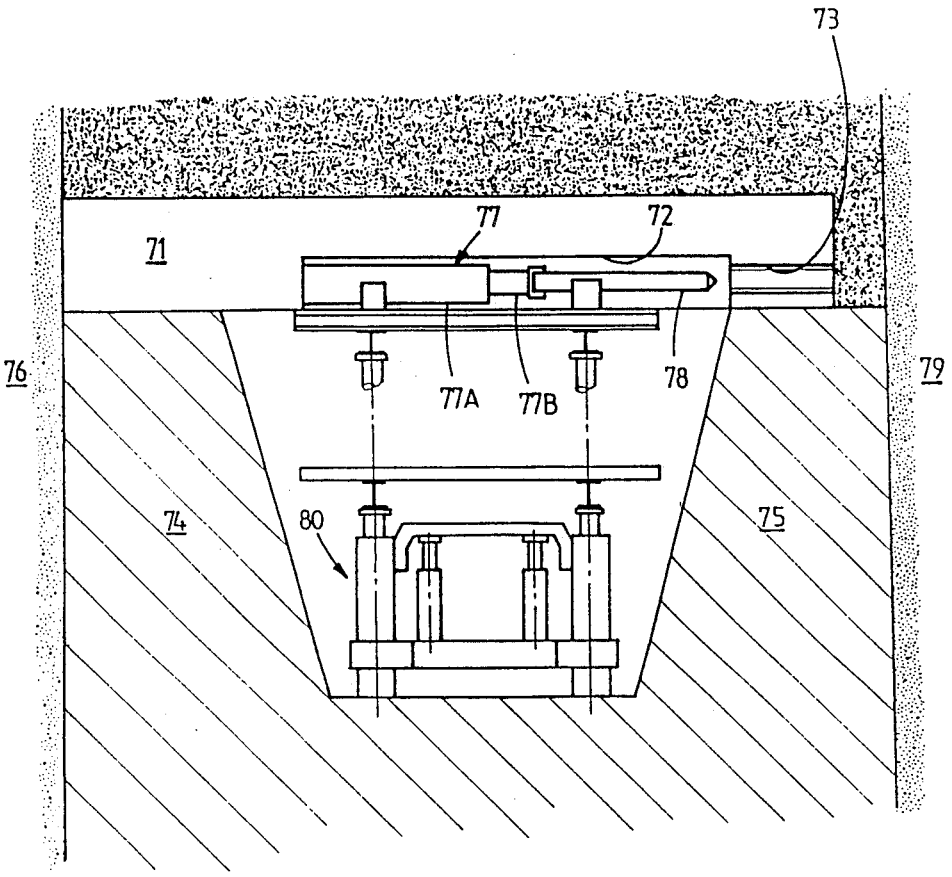
Figure 25:
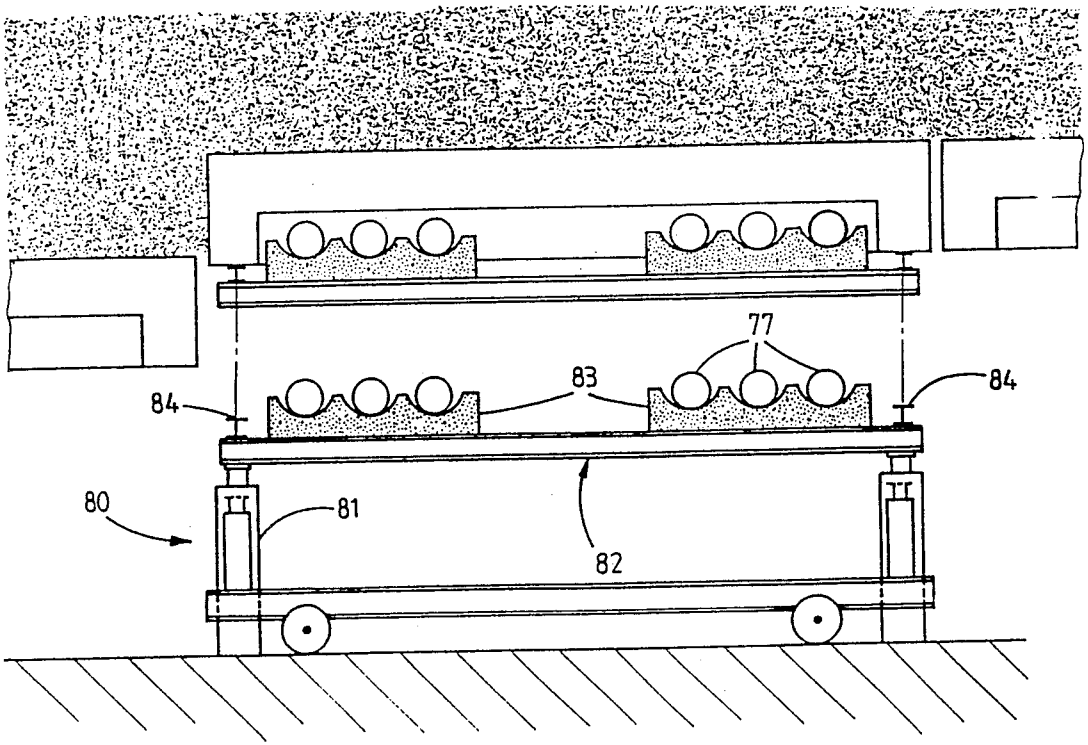
Figure 26:
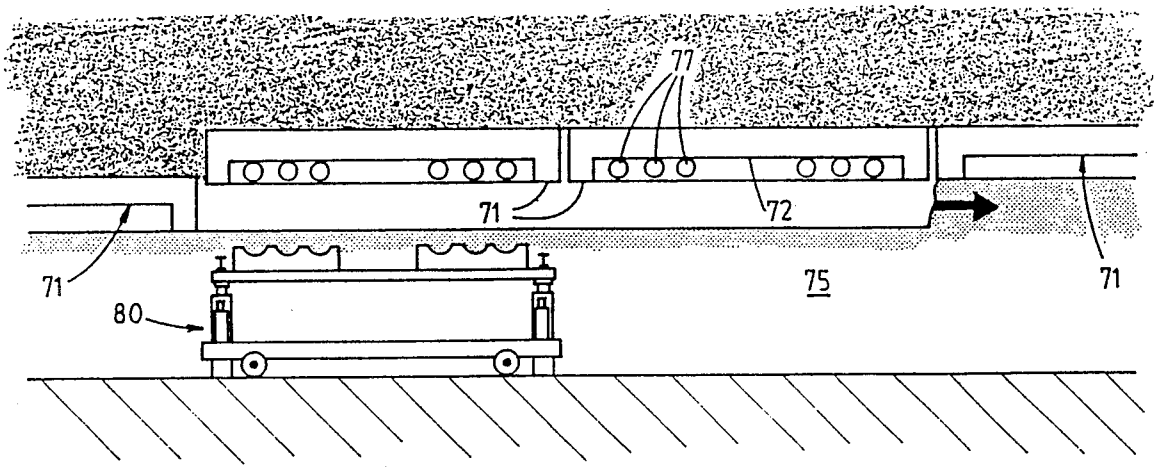

The roof slabs may equally well be anchored laterally to the walls of the lode by means of piston rods that are anchored directly into the walls of the lode, as shown in FIGS. 24 through 26 which show unitary construction roof slabs 71 featuring cavities 72 from which run lateral channels 73.

In FIG. 24 a roof slab 71 is supported by ore sub-walls 74 and 75 and bears at the lefthand end against a lode wall 76. Within the cavity 72 are transversely disposed jacks 77 the cylinders 77A of which bear agains the lefthand wall of the cavity and the pistons 77B of which are extended by rods 78 designed to enter the channel 73 and to bear up against the righthand lode wall 79. These jacks are fed with hydraulic fluid by flexible hoses that are not shown.

As can be seen from FIGS. 25 and 26, three jacks 77 may be provided at each end of each roof slab, operated for the time it takes to win the ore situated above the sub-walls 74 and 75.

A wheeled carriage 80 comprises a support structure 82 movable vertically by jacks 81 adapted to bear on the ground for stability and carrying cradles 83 for the groups of transverse jacks 77 and rails 84 adapted to bear on the bottom of the roof slabs for supporting them and guiding them as they are lowered.

The roof slabs have a length of 7 meters, for example, a width of 7.5 meters and a cavity 0.5 meter deep.

As the working face advances (from left to right in FIG. 26) the bottom of the tunnel is mined first and then the top. Before winning the ore from the top of the sub-walls supporting a roof slab (two roof slabs in this instance) the roof slab is supported laterally by installing jacks 77; the top layer of the ore is won, usually with the carriage 80 removed to provide more room, and then the carriage 80 is returned and the roof slabs supported on the rails 84 so that the pressure can be relieved in the jacks 77; the lowering of the roof slabs is controlled by the jacks 81. The manoeuvre is then repeated for the roof slab or slabs immediately to the right.

In FIGS. 24 through 26 the jacks 77 are all operative in the same direction to urge the roof slab towards one lode wall and the rods towards the other wall. In an alternative arrangement (not shown) that is recommended where the surface of the lode walls is irregular, the jacks are disposed in head-to-tail arrangement with the rods projecting from each side of the roof slab by means of channels 73 provided to each side of the central cavity, the walls of the central cavity in the roof slab taking the separation thrust.

It is to be understood that the previous description is given by way of example only and that those skilled in the art may propose numerous variations thereon without departing from the scope of the invention.

For example, jacks 40 for pressing the end elements against the walls of the lode may be replaced by a plurality of jacks individually pressing an end element against a wall of the lode, while directly bearing on the opposite wall of the lode, through opposite end element. Such jacks may, for example, bear on the expanding portion of an end element (near thicker portions 31C or 34C) and go through the opposite end element thanks to a recess 59 (see FIG. 22).

Such individual pressure means allow for example an alternative descending motion of one or the other of opposite end elements, one of such end elements remaining in its position while the other element is moved down, and conversely. Mining at ground level may thus take place, alternatively, along one or the other wall of the lode.

I claim:

1. Mining or underground quarrying method by downward slicing of ore under a roof, comprising the steps of:

dividing said roof into a substantially horizontal plurality of roof areas;

supporting said plurality of roof areas independently of one another by a plurality of independent roof slabs juxtaposed side by side respectively, said plurality of roof slabs providing together a deformable protecting roof for supporting caving material and protecting against same;

mining ore under said deformable protecting roof by excavating neighboring floor areas successively under each roof slab while supporting each roof slab in said plurality of roof slabs; and as said excavating is conducted, successively and individually lowering by a predetermined level each of said roof slabs after ore has been excavated under same, whereby roof areas of said plurality of roof areas are successively caved, said lowering of each said roof slabs being controlled by slab temporarily supporting and lowering means of variable height carried by at least one movable frame successively brought under roof slabs of said plurality of roof slabs.

2. Method according to claim 1, wherein the step of mining ore while supporting each roof slab, and the step of lowering slabs, include:

providing pillars of ore for supporting said roof slabs;

mining ore from between said pillars of ore;

supporting at least one of said roof slabs by said slab temporarily supporting and lowering means while keeping said means to a constant height;

mining down to a given level a top portion of each pillar of ore supporting said at least one of said roof slabs; and reducing the height of said slab temporarily supporting and lowering means till said at least one of said roof slabs is supported again by said pillars of ore.

3. Method according to claim 1, wherein the step of mining ore while supporting each roof slab and the step of lowering slabs include:

supporting at least one of said roof slabs by supporting posts suspended to said at least one of said roof slabs;

mining ore from between said supporting posts;

supporting said at least one of said roof slabs together with said supporting posts by said slab temporarily supporting and lowering means while keeping said means to a constant height;

mining ore under said supporting posts; and reducing the height of said slab temporarily supporting and lowering means till said at least one of said roof slabs is supported again by said supporting posts.

4. Method according to claim 1, wherein the step of mining ore while supporting each roof slab and the step of lowering slabs include:

supporting at least one of said roof slabs by supporting posts suspended to, and movable laterally with respect to, said at least one of said roof slabs;

mining ore from between said supporting posts;

supporting said at least one of said roof slabs together with said supporting posts, by said slab temporarily supporting and lowering means while keeping said means to a constant height;

moving laterally said supporting posts to above floor areas already excavated; and reducing the height of said means till said at least one of said roof slabs is supported again by said supporting posts.

5. Method according to claim 1 wherein the ore is a narrow lode and wherein supporting said roof slabs consists in laterally supporting said roof slabs against walls of said lode.

6. Method according to claim 1, wherein said roof slabs in said plurality are disposed in lines and rows, the steps of mining and lowering being conducted line by line.

7. Method according to claim 1, wherein said roof slabs in said plurality are disposed in lines and rows, the steps of mining and lowering being conducted row by row.

8. Method according to claim 1, wherein said roof slabs are in concrete.

9. Timbering and walling installation for mining and underground quarrying by downward slicing under a roof comprising:

a deformable protecting roof for supporting neighboring roof areas of said roof and for protection from overlying caving material, comprising a plurality of independent elementary roof slabs juxtaposed side by side;

slab supporting means under each of said roof slabs; and slab temporarily supporting and lowering means of variable height, carried by at least one movable frame and adapted to be moved successively under adjacent ones of said roof slabs for successively lowering said adjacent ones of said roof slabs by a predetermined level.

10. Installation according to claim 1, wherein said roof slabs are of reinforced concrete.

11. Installation according to claim 1, wherein said slab supporting means consist of ore.

12. Installation according to claim 1, wherein said slab supporting means are fixed and attached to said roof slabs.

13. Installation according to claim 12, wherein said slab supporting means are of reinforced concrete.

14. Installation according to claim 9, wherein said slab supporting means under at least one of said roof slabs are movable laterally.

15. Installation according to claim 9, wherein said slab supporting means are lateral abutment means applied laterally against facing walls of a lode with said roof slabs extending from one of said wall to the other.

16. Installation according to claim 15, wherein said lateral abutment means include jacks.

17. Installation according to claim 15, wherein said roof slabs are of a unitary construction type having a central cavity bordered by transverse walls and a plurality of transverse channels on at least one side of said cavity, horizontal jacks being provided to bear against the walls of the lode through said channels at one end and against one of the walls of the cavity at the other end.

18. Installation according to claim 1, wherein said roof slabs comprise two articulated vault elements forming a variable angle vault supported flying buttress fashion by the facing lode walls with two end elements articulated to the vault elements and adapted to lie along the said lode walls.

19. Installation according to claim 18, wherein horizontal jacks are provided to apply said end elements against the lode walls.

20. Installation according to claim 18, wherein at least one jack is provided for reducing the angle between the vault elements.

21. Installation according to claim 1, wherein a flexible metal mesh is placed between the roof slabs and the overlying caving material.

22. Installation according to claim 1, wherein gaps existing between roof slabs are protected by shields supported by deformable triangles.

23. Installation according to claim 1, wherein one of said roof slabs is fitted with a shield supported by deformable triangles and an adjacent one of said roof slabs comprises a cusp adapted to press down the shield when said adjacent roof slab is lowered.

24. Installation according to claim 1, comprising at least one row of roof slabs said slab supporting means of which are sufficiently far apart to permit mining machines to pass between said means.

25. Installation according to claim 1, wherein at least one of said roof slabs which is adjacent a wall comprises forepoling irons adapted to be advanced and retracted to provide protection between said one of said roof slabs and said wall.

26. Installation according to claim 25, wherein said forepoling irons are supported by pit props.

27. Installation according to claim 1, wherein said slab support and lowering means comprise hydraulic jacks.

* * * * *